United States Patent [19]

Saito

[11] 3,971,918

[45] July 27, 1976

[54] METHOD AND APPARATUS FOR MEASURING THE NUMBER OF STACKED CORRUGATED CARDBOARDS

[75] Inventor: Minoru Saito, Odawara, Japan

[73] Assignee: Nihon Electronic Industry Co. Ltd., Japan

[22] Filed: Dec. 12, 1974

[21] Appl. No.: 532,081

[30] Foreign Application Priority Data

Dec. 28, 1973 Japan ..... 49-2654

[52] U.S. Cl. ..... 235/92 SB; 235/92 V; 235/92 R; 235/98 C; 250/571

[51] Int. Cl.[2] ..... G06M 9/00

[58] Field of Search ..... 235/92 SB, 92 V, 92 PB, 235/98 C; 250/571; 93/93 C

[56] References Cited

UNITED STATES PATENTS 3,790,759 2/1974 Mohan et al. ..... 235/92 SB

*Primary Examiner*—Joseph M. Thesz

*Attorney, Agent, or Firm*—Ladas, Parry, Von Gehr, Goldsmith & Deschamps

[57] ABSTRACT

A method and an apparatus for measuring the number of a plurality of stacked corrugated cardboards. The one end of the stack is scanned horizontally and vertically by a photoelectric sensor, consisting of an array of 64 photodiodes switched in turn by electric pulses, for example, and the outputs of the photodiodes are counted and compared so as to successively detect the flat sheets and the corrugated sheets of the stacked corrugated cardboards. A counting and or a display device are operated in accordance with the order of the results of above detecting operations of the flat sheets and the corrugated sheets.

9 Claims, 4 Drawing Figures

METHOD AND APPARATUS FOR MEASURING THE NUMBER OF STACKED CORRUGATED CARDBOARDS

This invention relates to an improved method and apparatus for measuring the number of a plurality of stacking corrugated cardboards.

Measuring or counting the number of a plurality of stacked cardboards by an electro-optical system involves a number of difficult problems. Recently, such apparatus has been proposed as described in the specification of Japanese Pat. publication No. 43833 of 1971 (U.S. Pat. No. 3581067). According to the invention described in said patent publication an elongated light beam is obliquely projected upon one end of the stack and moved in the direction of the thickness of the stack (that is, in the vertical direction). The light reflected by the edges of the stack is received by a photoelectric sensor. This arrangement, however, can not correctly count the number of the stacked corrugated cardboards if there is a gap between adjacent corrugated cardboards, or when the base sheets of the cardboards are not perfectly flat but are wavy or where the light beam traverses obliquely the base sheets.

Accordingly, it is an object of this invention to provide an improved method and apparatus for precisely counting the number of a plurality of stacked corrugated cardboards without said defects.

According to one aspect of this invention there is provided a method of measuring the number of a plurality of stacked corrugated cardboards wherein one end of the stack is scanned horizontally and vertically by equivalent means of scanning light beam so as to successively detect the flat sheets and the corrugated sheets of the corrugated cardboards, characterized in that the results of scanning a flat base sheet of a corrugated cardboard are detected, that the results of scanning a corrugated sheet of the corrugated cardboard are detected, that the results of scanning a wavy base sheet of the corrugated cardboard are detected, and that a counting and or a display device are operated in accordance with the order of the results of said three detecting operations.

According to another aspect of this invention, there is provided apparatus for measuring the number of a plurality of stacked corrugated cardboards of the type wherein one end of the stack is scanned horizontally and vertically by equivalent means of a scanning light beam so as to successively detect the flat base sheets and the corrugated sheets of the corrugated cardboards, characterized in that there is provided a flat base sheet detector for detecting the scanning of a flat base sheet of a corrugated cardboard, a corrugated sheet detector for detecting the scanning of a corrugated sheet of the corrugated cardboard, a wavy base sheet detector for detecting the scanning of a wavy base sheet and means responsive to the operations of said three detectors for operating a counting and or a display device.

In this invention, the light reflected by the end of the stacked corrugated cardboards is received by a photoelectric sensor, consisting of an array of 64 photodiodes switched in turn by electric pulses, for example, and the outputs of the photodiodes are counted and compared.

This arrangement is equivalent to a photo-scanning device in which a fine light beam is moved in the vertical direction while being scanned in the horizontal direction. Use of a photodiode array eliminates the use of a pulse generator.

Although the scanning of the end of the stacked corrugated cardboards can be effected by moving a fine scanning light beam in the vertical direction and by producing electric pulses in response to the light reflected by the end edges of the stacked corrugated cardboards, it is advantageous to move in the vertical direction alone a narrow and long scanning light beam and to receive the reflected light by an array of a plurality of photodiodes switched in turn by electric pulses. By the provision of the flat base sheet detector, the corrugated sheet detector and the wavy base sheet detector, it is possible to accurately count the number of corrugated cardboards even when the base sheet is wavy or there is a gap between adjacent corrugated cardboards.

This invention can be more fully understood from the following description taken in conjunction with the accompanying drawings in which.

Figure 1:
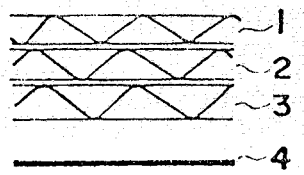
FIG. 1 shows the relationship between one end of a stack of plurality of corrugated cardboards and a scanning area which is used to scan the end in the direction of the thickness of the stacked corrugated cardboards.
Figure 2:
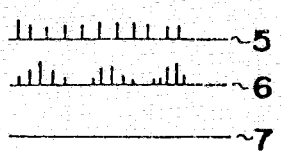
FIG. 2 shows wave forms of the outputs of a photoelectric detector utilized in the circuit shown in FIG. 3.

Referring now to FIG. 1 of the accompanying drawings there is shown an end view of a stack of three corrugated cardboards 1, 2 and 3 each comprising a wavy or corrugated sheet sandwiched between a pair of flat base sheets. A scanning area having a large width as shown by a reference number 4 is moved in the direction of the stack, that is, in the vertical direction as viewed in FIG. 1 to scan the end of the stack. When the lighted scanning area traverses the flat base sheets and the corrugated sheets, the reflected light from the scanning area is received by a well known linear self-scanning type photoelectric sensor comprising an array of 64 photodiodes, for example. Accordingly, as the scanning area is moved in the vertical direction, the end of the stack will be scanned as if a fine scanning beam is moved in the vertical direction while being scanned in the horizontal direction. More particularly, when the lighted scanning area is positioned upon one flat base sheet of a corrugated cardboard, all photodiodes will be excited sequentially to produce 64 pulses of the same amplitude as shown by a graph 5 in FIG. 2, whereas when the lighted scanning area is positioned upon a corrugated sheet, intermittent pulses as shown by graph 6 in FIG. 2 will be produced. Where there is a gap between adjacent corrugated cardboards and when the lighted scanning area is positioned upon such gap, the photodiode array will not produce any output shown by a straight line 7. As a consequence, where there is no gap between adjacent corrugated cardboards, the outputs of the photodiode array vary in the sequence of graphs 5, 6, 5, . . . , whereas where there are gaps, the outputs vary in the sequence of graphs 5, 6, 7, 5, 6 . . . For this reason, by detecting a combination 5, 6, 5 or 5, 6, 7, 5 as one information unit representing one corrugated cardboard and by counting the number of such detected units, it is possible to readily determine the number of corrugated cardboards which are stacked as shown in FIG. 1.

Figure 3:
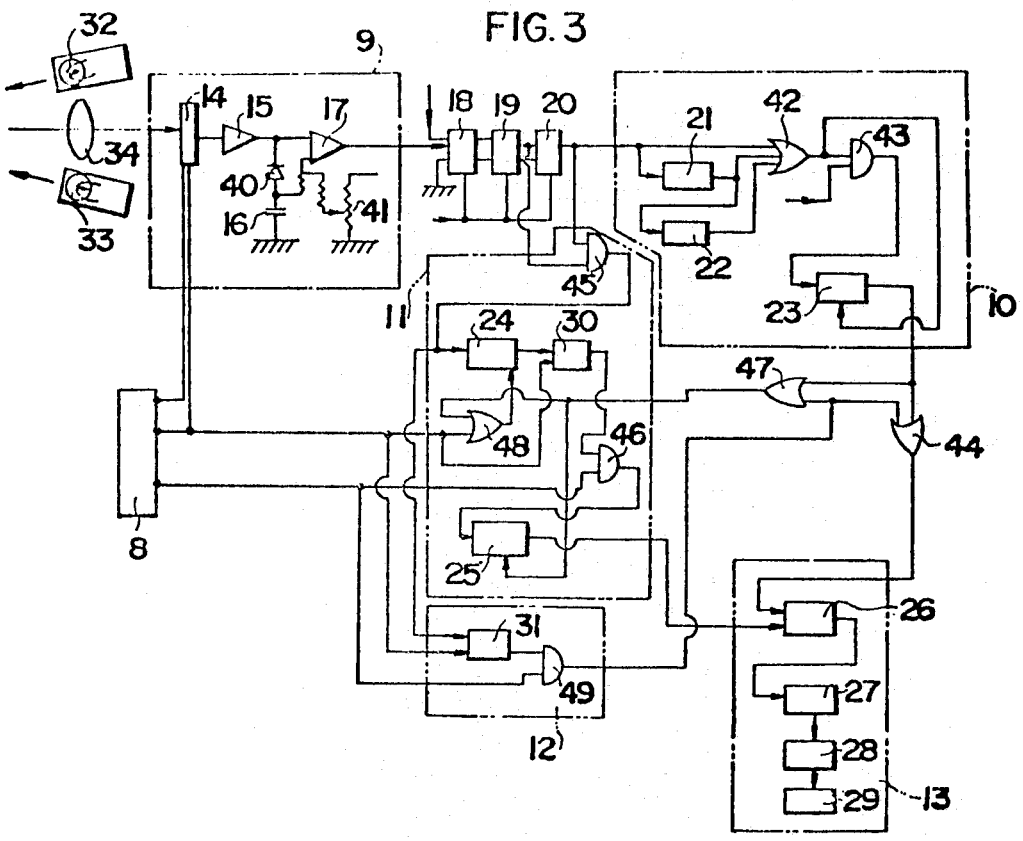
FIG. 3 is a block diagram of a counting apparatus embodying the invention.
Figure 4:
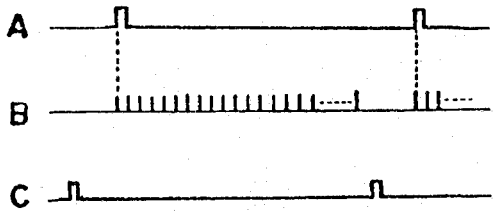
FIGS. 4A, 4B and 4C are graphs showing the relationship between the start pulse, detector output and sampling pulse utilized in the circuit shown in FIG. 3.

As shown in FIG. 3, the apparatus for counting the number of stacked corrugated cardboards comprises a control pulse generator 8 which generates a sensor driving pulse, a start pulse and a sampling pulse as will be described later in connection with FIG. 4, a sensor 9, a flat base sheet detector 10, a corrugated sheet detector 11, a zero detector 12 and a counting and display section 13. Sources of light 32 and 33 are provided to project a narrow lighted scanning area 4 as shown in FIG. 4 upon one end of a stack of a plurality of corrugated cardboards. The light reflected by the end edges of respective flat base sheets and corrugated sheets of the corrugated cardboards is received through a lens 34 by a linear self-scanning type photoelectric sensor element 14 including an array of 64 photodiodes as described above, which are sequentially actuated by the sensor driving pulse from the control pulse generator 8 so that respective photodiodes generate pulses whenever they receive light reflected by the end edge of the stack. The output pulses from the photodiodes are amplified by an amplifier 15 and then clipped by a clipper comprising a diode 40 and a capacitor 16, and the clipped pulses are compared by a comparator 17 with a definite reference voltage produced by a potentiometer 41. Thus, each output pulse having a magnitude larger than the reference voltage produces an 1 output which is passed through serially connected flip-flop circuits 18, 19 and 20 to remove any noise component contained in the outputs from the photodiode array 14. As has been pointed out before, the lamps 32 and 33 and the sensor 9 are moved in the vertical direction across the end of the stack so that the outputs shown by graphs 5, 6 and 7 are produced.

The output from the last flip-flop circuit 20 is applied to a pair of cascade connected shift registers 21 and 22 each having a capacity of 64 bits corresponding to the number of the photodiodes. The outputs from the flip-flop circuit 20 and shift registers 21 and 22 are applied to the inputs of an OR gate circuit 42 thus causing it to operate in response to a presently existing signal and two preceding signals from the flip-flop circuit 20. This arrangement assures accurate and ready measurement even when the flat base sheet is curved or wavy, or where the sensor is disposed obliquely with respect to the flat base sheet, or where the speed of moving the scanning light beam relative to the stack of the corrugated cardboards varies.

The output from the OR gate circuit 42 is applied to a counter 23 via an AND gate circuit 43 which is connected to receive a clock pulse at its one input. The counter 23 is constructed such that it contains 64 bits and produces and output 1 when its consecutive bits contain an input 1 numbering more than a predetermined number, for exâmple, 20, but it begins to count again when the number of the consecutive bits containing 1 is less than 20. The 1 output from the counter 23 means that the scanning area has traversed a flat base sheet and this output is applied to the set terminal of a flip-flop circuit 26 in the counting and display section 13 through an OR gate circuit 44. This 1 output is also used to reset a counter 24 in the corrugated sheet detector 11 in a manner to be described later. Thus, the outputs from the flip-flop circuits 19 and 20 are applied to the counter 24 through an AND gate circuit 45 to cause the counter 24 to count and produce an output 1 only when more than two signals higher than the reference signal produced by potentiometer 41, or 1 signals pass consecutively through flip-flop circuits 18, 19 and 20. The output signal from the counter 24 represents a point at which the scanning area crosses the corrugated sheet during one scanning cycle. The counter 24 produces an output when the number of such cross points exceeds 4, for example, and this output is applied to a flip-flop circuit 30 which is constructed to produce an output when the condition containing more than 4 cross points continues for more than three scanning cycles. Such a digital intergrating operation is performed for correctly identifying the corrugated sheet because similar output is produced when the scanning area traverses the flat base sheet. However, the output is produced only once when the scanning area crosses the flat base sheet whereas when the scanning area crosses the corrugated sheet a number of outputs are produced consecutively.

FIG. 4 shows a graph showing the time phase relationship between the start pulse (FIG. 4A), sensor outputs (FIG. 4B) and sampling pulse (FIG. 4C) generated by the control pulse generator 8. The sampling pulse advances than the next start pulse by 4 bits, for example. Assuming that the sensor 14 comprises 64 photodiodes and that one bit corresponds to 1 $\mu$s, then the sensor drive pulse has a frequency of 1 $MH_z$ and the sensor produces 64 outputs at each scanning cycle as shown in FIG. 4B under the control of the start pulse as shown in FIG. 4A. The sampling pulse and the 1 output of the flip-flop circuit 30 are applied to the inputs of an AND gate circuit 46 so that the output from flip-flop circuit is applied to counter 25 in the corrugated sheet detector 11 only when a sampling pulse exists. The counter 24 is reset by the output from counter 23 via two OR gate circuits 47 and 48, one input of OR gate circuit 48 being connected to receive the start pulse from the control pulse generator 8.

The purpose of the zero detector 12 is to prevent misoperation of the detecting device where the base sheet of the corrugated cardboard is thin and wavy. When a wavy base sheet is scanned, a number of pulses will be produced when the scanning area crosses the base plate just in the same manner as a corrugated sheet. In other words, a wavy base sheet is misjudged as a corrugated sheet. However, where a wavy base sheet of one corrugated cardboard is overlayed by a similar wavy base sheet or a flat base sheet of adjacent corrugated cardboard, by the action of two shift registers 21 and 22 of the flat base sheet detector 10, such wavy base sheet can be identified as a base sheet instead of a corrugated sheet. More particularly, where comparator 17 produces 1 output consecutively, so that the flip-flop circuits 19 and 20 produces outputs simultaneously, AND gate circuit 45 sets a flip-flop circuit 31 in the zero detector 12. Since the $\overline{Q}$ output of this flip-flop circuit 31 is applied to one input of an AND gate circuit 49, and since the sampling pulse as shown in FIG. 4C is applied to the other input of AND gate circuit 49, this AND gate circuit produces an output 1 when the reflected light is nothing, and this output is applied to flip-flop circuit 26 in the counting and display section 13 via OR gate circuit 44. In other words, when the base sheet is flat, the flip-flop circuit 26 is set by the 1 output from the flat base sheet detector 10 and when the base sheet is wavy the flip-flop circuit 26 is set by the 1 output from the zero detector 12. The flip-flop circuit 26 is reset by the output from counter 25 in the corrugated sheet detector 11. Accordingly, the flip-flop circuit 26 produces an output each time the end edge of one corrugated cardboard is traversed in the vertical direction as viewed in FIG. 3 by the scanning area. This output is applied to a counter 27 and the output there is decoded by a decoder 28 and displayed by a display device 29. According to this invention it is possible to correctly count the number of a plurality of stacked corrugated cardboards even when there is a gap between adjacent corrugated cardboards or the base sheets of the corrugated cardboards are wavy, said circuit 26 is set by the 1 output from the zero detector 12.

If desired, a suitable detector may be provided for detecting the number of scanning cycles which is performed while the scanning area is moved across the thickness of one corrugated cardboard to indicate the scanning frequency or to automatically control the scanning frequency.

To verify the result of counting, the result of counting may be set in a register for comparison with the result of next counting. If the results of two consecutive counting operations are equal, then the counting is identified correct and such correct value is applied to a register. In this manner, by applying the result of each counting operation, the total number of the corrugated cardboards which are stacked in various ways can be obtained.

What we claim is:

1. In a method of measuring the number of a plurality of stacked corrugated cardboards wherein one end of the stack is scanned vertically by means of a scanning light beam so as to successively detect the flat sheets and the corrugated sheets of the corrugated cardboards, wherein the improvement comprises scanning horizontally one end of the stack in the range of a predetermined width by a photoelectric sensor, said sensor including a plurality of linearly arranged photodiodes, sequentially actuating said photodiodes in linear order by electric pulses, detecting the results of the horizontal scanning of a flat base sheet of at least one of the corrugated cardboards, detecting the result of the horizontal scanning of the corrugated sheet of at least one of said corrugated cardboards, detecting the result of the horizontal scanning of a wavy base sheet of at least one of the corrugated cardboards, and operating a means for counting in accordance with the results of said three detecting operations.

2. The method according to claim 1, wherein the result of the scanning of at least one corrugated sheet is determined by comparing the number of pulses produced by at least one said horizontal scan with the number of pulses produced from at least one preceding horizontal scan which are generated when a corrugated sheet is scanned.

3. The method according to claim 1, wherein a gap between adjacent corrugated cardboards is determined by comparing the number of pulses produced by at least one horizontal scan with the number of pulses produced from the preceding horizontal scan, and then producing a negative digital pulse when a gap is detected.

4. In an apparatus for measuring the number of a plurality of stacked corrugated cardboards of the type wherein one end of the stack is scanned vertically by a scanning light beam and a sensor so as to successively detect the flat base sheets and the corrugated sheets of the corrugated cardboards, wherein the improvement comprises a photoelectric sensor including a plurality of photodiodes disposed in a linear arrangement and which are actuated in linear order by electric pulses for horizontally scanning one end of the stack, a flat base sheet detector to detect the results of the horizontal scanning of a flat base sheet of at least one corrugated cardboard, a corrugated sheet detector to detect the results of the horizontal scanning of a corrugated sheet of said one corrugated cardboard, a wavy base sheet detector to detect the results of the horizontal scanning of a wavy base sheet that may be present, a counting device, and means for operating said counting device responsive to the results of said three detectors.

5. The apparatus according to claim 4 further comprising means for providing a narrow lighted scanning area having predetermined width open one end of the stack, means to move said lighted scanning area vertically along said end of the stack, said photodiodes being responsive to the reflected light from the scanning area upon the end of said stack when said scanning area traverses a flat base sheet and a courrugated sheet of at least one corrugated cardboard, means for generating digital pulses comprising the driving pulses for said photodiodes, said flat base sheet detector having means responsive to the results of at least one horizontal scan and the results of a plurality of preceding scans for producing a signal, and a counter responsive to said signal for producing an output when said signal is produced repeatedly for a number of times exceeding a predetermined number.

6. The apparatus according to claim 5, wherein said corrugated sheet detector further includes a counter means and a plurality of flip-flop circuits, said counter means responsive to the output of a predetermined number of said flip-flop circuits which are connected between said counter and said sensor for operating said counter means which produces an output when said scanning crosses said corrugated sheet at a number of points larger than a predetermined number.

7. The apparatus according to claim 5, which further includes a zero detector which comprises a flip-flop circuit connnected to the output from said means for operating a counting device.

8. The apparatus according to claim 7, further comprising a decoder for decoding the output from said counter and a display device for displaying the output of said decoder.

9. The apparatus according to claim 4, wherein said counting device comprises a flip-flop circuit connected to receive the outputs of said three of said three detectors for producing an output whenever one corrugated cardboard of said stack is traversed by the lighted scanning area, and a counter for counting the number of the outputs from said flip-flop circuit.

* * * * *